US009476436B2

(12) United States Patent
Ogawa

(10) Patent No.: US 9,476,436 B2
(45) Date of Patent: Oct. 25, 2016

(54) ACTUATOR

(71) Applicant: KAYABA INDUSTRY CO., LTD., Tokyo (JP)

(72) Inventor: Takayuki Ogawa, Kanagawa (JP)

(73) Assignee: KYB Corporation, Tokyo (JP)

( * ) Notice: Subject to any disclaimer, the term of this patent is extended or adjusted under 35 U.S.C. 154(b) by 196 days.

(21) Appl. No.: 14/408,573

(22) PCT Filed: Aug. 22, 2013

(86) PCT No.: PCT/JP2013/072361

§ 371 (c)(1),
(2) Date: Dec. 17, 2014

(87) PCT Pub. No.: WO2014/034510

PCT Pub. Date: Mar. 6, 2014

(65) Prior Publication Data

US 2015/0184681 A1 Jul. 2, 2015

(30) Foreign Application Priority Data

Sep. 3, 2012 (JP) ..... 2012-192754

(51) Int. Cl.

| | |
|---|---|
| ***F15B 13/04*** | (2006.01) |
| ***F15B 15/14*** | (2006.01) |
| ***F15B 15/22*** | (2006.01) |
| ***F15B 11/044*** | (2006.01) |

(Continued)

(52) U.S. Cl.

CPC ..... *F15B 15/149* (2013.01); *B61F 5/245* (2013.01); *F15B 1/26* (2013.01); *F15B 11/0445* (2013.01); *F15B 11/17* (2013.01); *F15B 15/224* (2013.01); *F15B 21/14* (2013.01); *F15B 15/204* (2013.01); *F15B 2211/20538* (2013.01); *F15B 2211/20576* (2013.01); *F15B 2211/27* (2013.01);

(Continued)

(58) Field of Classification Search

CPC F15B 11/044; F15B 11/0445; F15B 15/149; F15B 15/224; F15B 2211/20576

See application file for complete search history.

(56) References Cited

U.S. PATENT DOCUMENTS 3,465,645 A * 9/1969 Alain ..... B62D 5/22 91/51
4,210,064 A * 7/1980 Beerens ..... F15B 15/224 91/452

(Continued)

FOREIGN PATENT DOCUMENTS

DE 102010011912 A1 9/2011
EP 2039582 A2 3/2009

(Continued)

*Primary Examiner* — Michael Leslie
(74) *Attorney, Agent, or Firm* — Rabin & Berdo, P.C.

(57) ABSTRACT

An actuator includes a cylinder, a piston, a rod, a rod-side chamber and a piston-side chamber, a tank, a first pump capable of supplying liquid to the rod-side chamber, a second pump capable of supplying the liquid to the piston-side chamber, a first control passage allowing communication between the rod-side chamber and the tank, a second control passage allowing communication between the piston-side chamber and the tank, a first variable relief valve capable of changing a valve opening pressure for permitting a flow of the liquid by being opened when a pressure in the rod-side chamber reaches the valve opening pressure, a second variable relief valve capable of changing a valve opening pressure for permitting a flow of the liquid by being opened when a pressure in the piston-side chamber reaches the valve opening pressure, and a center passage allowing communication between the tank and the interior of the cylinder.

5 Claims, 3 Drawing Sheets

(51) Int. Cl.

| | |
|---|---|
| ***F15B 11/17*** | (2006.01) |
| ***F15B 1/26*** | (2006.01) |
| ***F15B 21/14*** | (2006.01) |
| ***B61F 5/24*** | (2006.01) |
| *F15B 15/20* | (2006.01) |

(52) U.S. Cl.
CPC ..... *F15B2211/41581* (2013.01); *F15B 2211/50518* (2013.01); *F15B 2211/5154* (2013.01); *F15B 2211/5159* (2013.01); *F15B 2211/526* (2013.01); *F15B 2211/57* (2013.01); *F15B 2211/7051* (2013.01); *F15B 2211/7053* (2013.01)

(56) References Cited

U.S. PATENT DOCUMENTS 7,516,613 B2 * 4/2009 Kadlicko ..... F15B 21/14 60/428
2004/0112312 A1 * 6/2004 Masse ..... F01L 9/02 123/90.12
2011/0192157 A1 8/2011 Ogawa

FOREIGN PATENT DOCUMENTS

| | | | | |
|---|---|---|---|---|
| EP | 2330302 | A1 | 6/2011 | |
| JP | 52-066164 | A | 6/1977 | |
| JP | 59-010505 | U | 1/1984 | |
| JP | 11-117907 | A | 4/1999 | |
| JP | 2001-208004 | A | 8/2001 | |
| JP | 2001-214903 | A | 8/2001 | |
| JP | 2002-295413 | A | 10/2002 | |
| JP | 2003-042216 | A | 2/2003 | |
| JP | 2004-510907 | A | 4/2004 | |
| JP | 2010-065797 | A | 3/2010 | |
| JP | 2011-202675 | A | 10/2011 | |
| RU | WO 2006121366 | A1 * | 11/2006 | ..... F15B 9/03 |

* cited by examiner

ACTUATOR

TECHNICAL FIELD

The present invention relates to an actuator.

BACKGROUND ART

Actuators are, for example, known to be interposed between a vehicle body and a truck to suppress vibration in a lateral direction with respect to a traveling direction of the vehicle body of a railway vehicle.

Some of the above actuators are configured to include, for example, a cylinder, a piston slidably inserted into the cylinder, a rod inserted into the cylinder and coupled to the piston, a rod-side chamber and a piston-side chamber partitioned by the piston in the cylinder, a tank, a first on-off valve provided at an intermediate position of a first passage allowing communication between the rod-side chamber and the piston-side chamber, a second on-off valve provided at an intermediate position of a second passage allowing communication between the piston-side chamber and the tank, a pump for supplying liquid to the rod-side chamber, a motor for driving the pump, a discharge passage connecting the rod-side chamber to the tank and a variable relief valve provided at an intermediate position of the discharge passage.

For example, according to an actuator disclosed in JP2010-65797A, a direction of a thrust force to be output can be determined by appropriately opening and closing a first on-off valve and a second on-off valve. A thrust force of a desired magnitude can be output in a desired direction by adjusting a relief pressure of a variable relief valve to control a pressure in the cylinder while rotating a pump at a constant speed by a motor to supply at a constant flow rate into the cylinder.

SUMMARY OF INVENTION

In the case of suppressing lateral vibration of a vehicle body of a railway vehicle by the above actuator, the vibration of the vehicle body can be suppressed if lateral acceleration of the vehicle body is detected by an acceleration sensor and a thrust force comparable to the detected acceleration is output from the actuator. However, since steady acceleration acts on the vehicle body, for example, when the railway vehicle is traveling in a curved section, the thrust force output by the actuator may become extremely large due to noise and drift input to the acceleration sensor.

Further, the vehicle body is supported on the truck via an air spring or the like. Particularly, in a bolsterless truck, if the vehicle body laterally sways relative to the vehicle body, the air spring generates a reaction force to return the vehicle body to a center.

Thus, when the railway vehicle is traveling in a curved section and the vehicle body sways relative to the truck, if the actuator outputs a large thrust force in a direction to return the vehicle body to a neutral position due to noise and drift described above, the air spring also generates a reaction force in the same direction. Thus, there is a possibility that a force for returning the vehicle body to the neutral position becomes excessive, the vehicle body is displaced to an opposite side beyond the neutral position and it becomes difficult to converge the vibration of the vehicle body.

The present invention was developed in view of the above problem and aims to provide an actuator capable of stably suppressing the vibration of a vibration control object.

According to one aspect of the present invention, an actuator includes a cylinder, a piston slidably inserted into the cylinder, a rod inserted into the cylinder and coupled to the piston, a rod-side chamber and a piston-side chamber partitioned by the piston in the cylinder, a tank, a first pump capable of supplying liquid to the rod-side chamber, a second pump capable of supplying the liquid to the piston-side chamber, a first control passage allowing communication between the rod-side chamber and the tank, a second control passage allowing communication between the piston-side chamber and the tank, a first variable relief valve provided at an intermediate position of the first control passage and capable of changing a valve opening pressure for permitting a flow of the liquid from the rod-side chamber toward the tank by being opened when a pressure in the rod-side chamber reaches the valve opening pressure, a second variable relief valve provided at an intermediate position of the second control passage and capable of changing a valve opening pressure for permitting a flow of the liquid from the piston-side chamber to the tank by being opened when a pressure in the piston-side chamber reaches the valve opening pressure, and a center passage allowing communication between the tank and the interior of the cylinder.

DESCRIPTION OF EMBODIMENTS

Hereinafter, an embodiment of the present invention is described with reference to the accompanying drawings.

Figure 1:
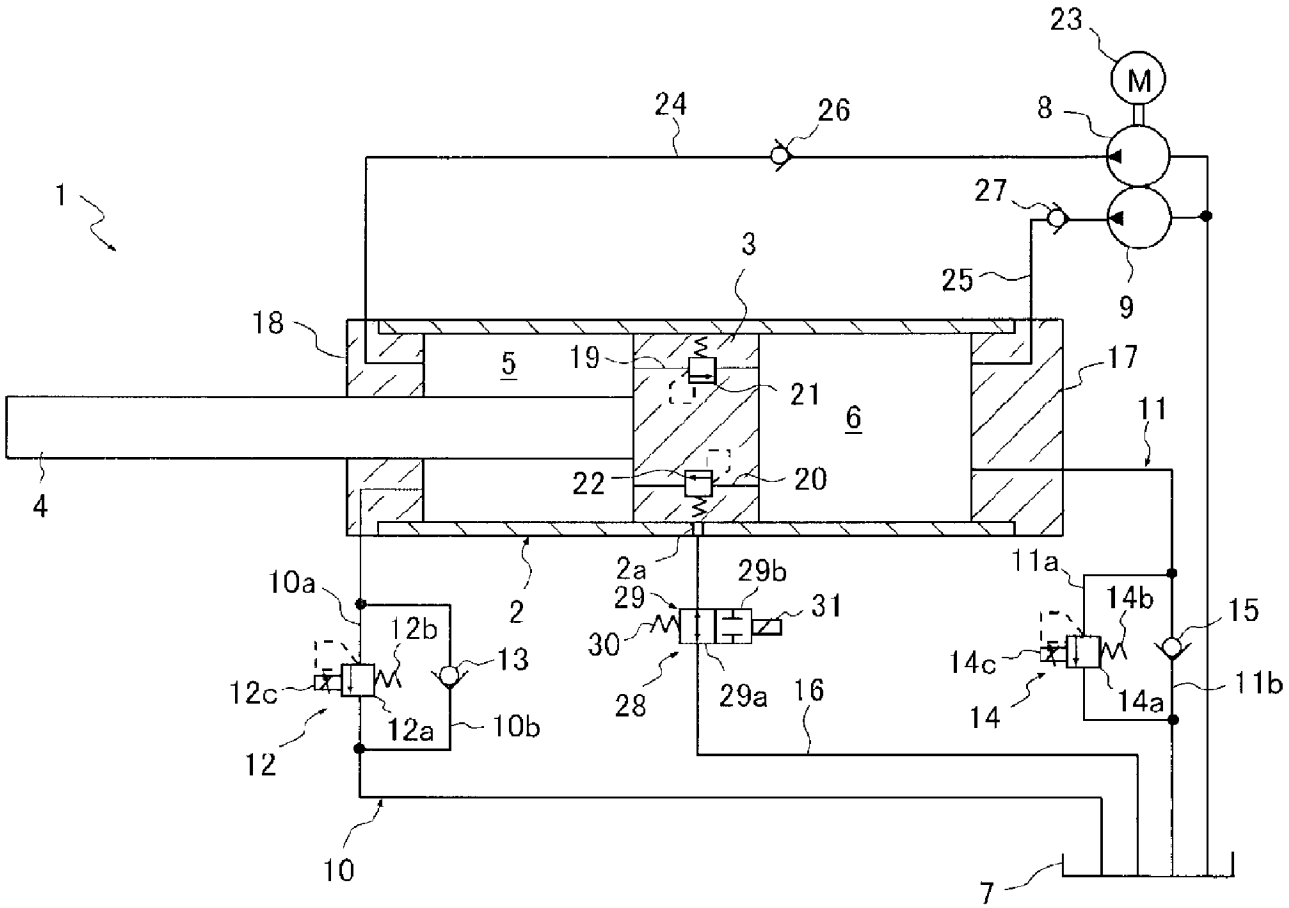
FIG. 1 is a schematic diagram of an actuator according to an embodiment of the present invention.

As shown in FIG. 1, the actuator 1 is configured to include a cylinder 2, a piston 3 slidably inserted into the cylinder 2, a rod 4 inserted into the cylinder 2 and coupled to the piston 3, a rod-side chamber 5 and a piston-side chamber 6 partitioned by the piston 3 in the cylinder 2, a tank 7, a first pump 8 capable of supplying liquid to the rod-side chamber 5, a second pump 9 capable of supplying the liquid to the piston-side chamber 6, a first control passage 10 allowing communication between the rod-side chamber 5 and the tank 7, a second control passage 11 allowing communication between the piston-side chamber 6 and the tank 7, a first variable relief valve 12 provided at an intermediate position of the first control passage 10 and capable of changing a valve opening pressure for permitting a flow of the liquid from the rod-side chamber 5 toward the tank 7 by being opened when a pressure in the rod-side chamber 5 reaches the valve opening pressure, a second variable relief valve 14 provided at an intermediate position of the second control passage 11 and capable of changing a valve opening pressure for permitting a flow of the liquid from the piston-side chamber 6 toward the tank 7 by being opened when a pressure in the piston-side chamber 6 reaches the valve opening pressure, and a center passage 16 allowing communication between the tank 7 and the interior of the cylinder 2. The liquid such as hydraulic oil is filled in the rod-side chamber 5 and the piston-side chamber 6, and gas is filled in the tank 7 in addition to the liquid. It should be noted that the interior of the tank 7 needs not be pressurized by compressing and filling the gas, but may be pressurized.

By making a force obtained by multiplying the pressure in the piston-side chamber 6 by the area of the piston 3 facing the piston-side chamber 6 (piston-side pressure receiving area) larger than a resultant force of a force obtained by multiplying the pressure in the rod-side chamber 5 by the area of the piston 3 facing the rod-side chamber 5 (rod-side pressure receiving area) and a force obtained by multiplying a pressure outside the actuator 1 by the cross-sectional area of the rod 4 by adjusting the valve opening pressure of the first variable relief valve 12 and that of the second variable relief valve 14 while driving the first and second pumps 8, 9, the actuator 1 can be caused to exert a thrust force in an extension direction corresponding to a differential pressure between the rod-side chamber 5 and the piston-side chamber 6. On the contrary, by making the resultant force of the force obtained by multiplying the pressure in the rod-side chamber 5 by the rod-side pressure receiving area and the force obtained by multiplying the pressure outside the actuator 1 by the cross-sectional area of the rod 4 larger than the force obtained by multiplying the pressure in the piston-side chamber 6 by the piston-side pressure receiving area by adjusting the valve opening pressure of the first variable relief valve 12 and that of the second variable relief valve 14 while driving the first and second pumps 8, 9, the actuator 1 can be caused to exert a thrust force in a contraction direction corresponding to the differential pressure between the rod-side chamber 5 and the piston-side chamber 6.

Each component is described in detail below. The cylinder 2 is tubular, one end part is closed with a lid 17, and an annular rod guide 18 is attached to the other end part. Further, the rod 4 is slidably inserted through the rod guide 18. One end part of the rod 4 projects out from the cylinder 2, and the other end part is coupled to the piston 3 similarly slidably inserted into the cylinder 2.

It should be noted that a space between the outer periphery of the rod 4 and the rod guide 8 is sealed by an unillustrated seal member, whereby the interior of the cylinder 2 is sealed. The hydraulic oil is filled as the liquid in the rod-side chamber 5 and the piston-side chamber 6 partitioned by the piston 3 in the cylinder 2.

The end part of the rod 4 projecting out from the cylinder 2 and the lid 17 for closing the one end part of the cylinder 2 include unillustrated mounting portions, so that the actuator 1 can be interposed between vibration control objects, such as between a vehicle body and a truck of a railway vehicle.

The rod-side chamber 5 and the piston-side chamber 6 are allowed to communicate by an extension-side relief passage 19 and a compression-side relief passage 20 provided in the piston 3. An extension-side relief valve 21 which is opened to open the extension-side relief passage 19 when the pressure in the rod-side chamber 5 becomes larger than the pressure in the piston-side chamber 6 by a predetermined amount and allows the pressure in the rod-side chamber 5 to escape to the piston-side chamber 6 is provided at an intermediate position of the extension-side relief passage 19. Further, a compression-side relief valve 22 which is opened to open the compression-side relief passage 20 when the pressure in the piston-side chamber 6 becomes larger than the pressure in the rod-side chamber 5 by a predetermined amount and allows the pressure in the piston-side chamber 6 to escape to the rod-side chamber 5 is provided at an intermediate position of the compression-side relief passage 20. Whether or not to dispose the extension-side relief valve 21 and the compression-side relief valve 22 is arbitrary, but it is possible to prevent a pressure in the cylinder 2 from becoming excessive and protect the actuator 1 by providing these.

The first variable relief valve 12 and a first check valve 13 are provided in parallel at intermediate positions of the first control passage 10 allowing communication between the rod-side chamber 5 and the tank 7. The first control passage 10 includes a main passage 10*a* and a branch passage 10*b* branched off from the main passage 10*a* and joining the main passage 10*a* again. It should be noted that although the first control passage 10 is composed of the main passage 10*a* and the branch passage 10*b* branched off from the main passage 10*a*, the first control passage 10 may be composed of two passages independent of each other.

The first variable relief valve 12 is configured to include a valve body 12*a* provided at an intermediate position of the main passage 10*a* of the first control passage 10, a spring 12*b* for biasing the valve body 12*a* to block the main passage 10*a*, and a proportional solenoid 12*c* for generating a thrust force for counteracting a biasing force of the spring 12*b* at the time of energization, and the valve opening pressure can be adjusted by adjusting the amount of current flowing through the proportional solenoid 12*c*.

The first variable relief valve 12 opens the first control passage 10 by moving the valve body 12*a* backward to permit a movement of the liquid from the rod-side chamber 5 toward the tank 7 when the pressure in the rod-side chamber 5 increases and a resultant force of a thrust force resulting from the pressure for pushing the valve body 12*a* in a direction to open the first control passage 10 and a thrust force by the proportional solenoid 12*c* overcomes a biasing force of the spring 12*b* for biasing the valve body 12*a* in a direction to block the first control passage 10. On the contrary, the first variable relief valve 12 is not opened to block a flow of the liquid from the tank 7 toward the rod-side chamber 5.

It should be noted that the first variable relief valve 12 can increase a thrust force generated by the proportional solenoid 12*c* if the amount of current supplied to the proportional solenoid 12*c* is increased. Accordingly, the valve opening pressure of the first variable relief valve 12 is minimized if the amount of current supplied to the proportional solenoid 12*c* is maximized and, on the contrary, the valve opening pressure is maximized if a current is not supplied to the proportional solenoid 12*c* at all.

The first check valve 13 is provided at an intermediate position of the branch passage 10*b* of the first control passage 10. The first check valve 13 permits only the flow of the liquid from the tank 7 toward the rod-side chamber 5, but blocks the flow in an opposite direction.

The second variable relief valve 14 and a second check valve 15 are provided in parallel at intermediate positions of the second control passage 11 allowing communication between the piston-side chamber 6 and the tank 7. The second control passage 11 includes a main passage 11*a* and a branch passage 11*b* branched off from the main passage 11*a* and joining the main passage 11*a* again. It should be noted that although the second control passage 11 is composed of the main passage 11*a* and the branch passage 11*b* branched off from the main passage 11*a*, the second control passage 11 may be composed of two passages independent of each other.

The second variable relief valve 14 is configured to include a valve body 14*a* provided at an intermediate position of the main passage 11*a* of the second control passage 11, a spring 14*b* for biasing the valve body 14*a* to block the main passage 11*a*, and a proportional solenoid 14*c* for generating a thrust force for counteracting a biasing force of the spring 14*b* at the time of energization, and the valve opening pressure can be adjusted by adjusting the amount of current flowing through the proportional solenoid 14*c*.

The second variable relief valve 14 opens the second control passage 11 by moving the valve body 14*a* backward to permit a movement of the liquid from the piston-side chamber 6 toward the tank 7 when the pressure in the piston-side chamber 6 increases and a resultant force of a thrust force resulting from the pressure for pushing the valve body 14*a* in a direction to open the second control passage 11 and a thrust force by the proportional solenoid 14*c* overcomes a biasing force of the spring 14*b* for biasing the valve body 14*a* in a direction to block the second control passage 11. On the contrary, the second variable relief valve 14 is not opened to block a flow of the liquid from the tank 7 toward the piston-side chamber 6.

It should be noted that the second variable relief valve 14 can increase a thrust force generated by the proportional solenoid 14*c* if the amount of current supplied to the proportional solenoid 14*c* is increased. Accordingly, the valve opening pressure of the second variable relief valve 14 is minimized if the amount of current supplied to the proportional solenoid 14*c* is maximized and, on the contrary, the valve opening pressure is maximized if a current is not supplied to the proportional solenoid 14*c* at all.

The second check valve 15 is provided at an intermediate position of the branch passage 11*b* of the second control passage 11. The second check valve 15 permits only the flow of the liquid from the tank 7 toward the piston-side chamber 6, but blocks the flow in an opposite direction.

The first and second pumps 8, 9 are pumps for sucking up the liquid from the tank 7 and discharging the liquid, and driven by a motor 23 in the present embodiment. A discharge port of the first pump 8 communicates with the rod-side chamber 5 through a supply passage 24. When the first pump 8 is driven by the motor 23, the liquid is sucked up from the tank 7 and supplied to the rod-side chamber 5. A discharge port of the second pump 9 communicates with the piston-side chamber 6 through a supply passage 25. When the second pump 9 is driven by the motor 23, the liquid is sucked up from the tank 7 and supplied to the piston-side chamber 6.

Since the first and second pumps 8, 9 discharge the liquid only in one direction and do not switch a rotating direction as described above, there is no problem that a discharge amount changes when the rotation is switched and inexpensive gear pumps or the like can be used. Further, since the first and second pumps 8, 9 constantly rotate in the same direction, these can be tandem pumps. Thus, one motor 23 can be a drive source for driving the first and second pumps 8, 9. Further, since the motor 23 has only to rotate in one direction, high responsiveness to rotation switch is not required and, accordingly, an inexpensive motor can be used.

It should be noted that check valves 26, 27 for preventing reverse flows of the liquid from the rod-side chamber 5 and the piston-side chamber 6 to the first and second pumps 8, 9 are provided at intermediate positions of the supply passages 24, 25.

Further, a through hole 2*a* allowing communication between the inside and the outside of the cylinder 2 is provided at a position facing the piston 3 of the cylinder 2 when the piston 3 is at the neutral position relative to the cylinder 2, in this case, in the center of the cylinder 2. The through hole 2*a* communicates with the tank 7 via the center passage 16, whereby the interior of the cylinder 2 and the tank 7 communicate. The neutral position of the piston 3 is not necessarily limited to the center of the cylinder 2 and may be arbitrarily set. It should be noted that, in the present embodiment, the position of the cylinder 2 where the through hole 2*a* is perforated is matched with a stroke center of the piston 3. Thus, the interior of the cylinder 2 communicates with the tank 7 through the center passage 16 except in the case where the through hole 2*a* is closed by facing the piston 3.

Further, an on-off valve 28 switchable between a state where the center passage 16 is opened and a state where the center passage 16 is blocked is provided at an intermediate position of the center passage 16. The on-off valve 28 is an electromagnetic on-off valve including a valve main body 29 having a communication position 29*a* where the center passage 16 is opened and a blocking position 29*a* where the center passage 16 is blocked, a spring 30 for biasing the valve main body 29 to position it at the blocking position 29*b*, and a solenoid 31 for switching the valve main body 29 to the communication position 29*a* against a biasing force of the spring 30 at the time of energization. It should be noted that the on-off valve 28 may be an on-off valve, which is manually opened and closed, instead of the electromagnetic on-off valve.

Next, the operation of the actuator 1 is described. First, a case where the on-off valve 28 blocks the center passage 16 is described.

When the center passage 16 is blocked, a pressure does not escape from the center passage 16 to the tank 7 regardless of the position of the piston 3 relative to the cylinder 2 caused by the extension and the contraction of the actuator 1. In the actuator 1, the liquid is supplied to the rod-side chamber 5 and the piston-side chamber 6 respectively from the first and second pumps 8, 9, the pressure in the rod-side chamber 5 can be adjusted by the first variable relief valve 12 and the pressure in the piston-side chamber 6 can be adjusted by the second variable relief valve 14. Accordingly, the direction and magnitude of the thrust force of the actuator 1 can be controlled by adjusting the valve opening pressure of the first variable relief valve 12 and that of the second variable relief valve 14 to adjust a differential pressure between the pressure in the rod-side chamber 5 and that in the piston-side chamber 6.

For example, in the case of causing the actuator 1 to output a thrust force in the extension direction, the valve opening pressure of the first variable relief valve 12 and that of the second variable relief valve 14 are adjusted while the liquid is supplied to the rod-side chamber 5 and the piston-side chamber 6 respectively from the first and second pumps 8, 9.

Here, since the piston 3 receives the pressure in the rod-side chamber 5 with an annular surface facing the rod-side chamber 5, a resultant force (rod-side force) of a force obtained by multiplying the pressure in the rod-side chamber 5 by the rod-side pressure receiving area, which is the area of the above annular surface, and a force obtained by multiplying the pressure outside the actuator 1 by the cross-section of the rod 4 acts in a direction to contract the actuator 1. Further, since the piston 3 receives the pressure in the piston-side chamber 6 with a surface facing the piston-side chamber 6, a force (piston-side force) obtained by multiplying the pressure in the piston-side chamber 6 by the piston-side pressure receiving area, which is the area of the above surface, acts in a direction to extend the actuator 1. Since the first variable relief valve 12 is opened to allow the pressure in the rod-side chamber 5 to escape to the tank 7 when the valve opening pressure is reached, the pressure in the rod-side chamber 5 can be made equal to the valve opening pressure of the first variable relief valve 12. Since the second variable relief valve 14 is opened to allow the pressure in the piston-side chamber 6 to escape to the tank 7 when the valve opening pressure is reached, the pressure in the piston-side chamber 6 can be made equal to the valve opening pressure of the second variable relief valve 14. Thus, the actuator 1 can be caused to exert a desired thrust force in the extension direction by adjusting the pressure in the rod-side chamber 5 and that in the piston-side chamber 6 such that the piston-side force exceeds the rod-side force and a force obtained by subtracting the rod-side force from the piston-side force has a desired magnitude.

Conversely, in the case of causing the actuator 1 to exert a desired thrust force in the contraction direction, the pressure in the rod-side chamber 5 and that in the piston-side chamber 6 may be so adjusted that the rod-side force exceeds the piston-side force and a force obtained by subtracting the piston-side force from the rod-side force has a desired magnitude by adjusting the valve opening pressure of the first variable relief valve 12 and that of the second variable relief valve 14 while driving the first and second pumps 8, 9.

To control the thrust force of the actuator 1 as described above, it is sufficient to grasp relationships of the first and second variable relief valves 12, 14 with the amount of current to each proportional solenoid 12*c*, 14*c* and the valve opening pressure and an open-loop control can be executed. Further, the amounts of energization to the proportional solenoids 12*c*, 14*c* may be sensed and a feedback control may be executed using a current loop. Further, it is also possible to execute a feedback control by sensing the pressure in the rod-side chamber 5 and that in the piston-side chamber 6. It should be noted that if the valve opening pressure of the first variable relief valve 12 is minimized in the case of extending the actuator 1 and the valve opening pressure of the second variable relief valve 14 is minimized in the case of contracting the actuator 1, one of the first and second pumps 8, 9 can be set in an unloaded state and energy consumption of the motor 23 can be minimized.

Further, also when it is desired to obtain a desired counteracting thrust force in the extension direction in a state where the actuator 1 receives an external force and is contracting, the desired thrust force can be obtained by adjusting the valve opening pressure of the first variable relief valve 12 and that of the second variable relief valve 14 in the same way as obtaining a thrust force in the extension direction in a state where the actuator 1 is extending. The same holds true also when it is desired to obtain a desired counteracting thrust force in the contraction direction in a state where the actuator 1 receives an external force and is extending.

It should be noted that since the actuator 1 does not exert a thrust force not smaller than an external force when extending or contracting by receiving the external force as just described, it suffices to cause the actuator 1 to function as a damper. Since the actuator 1 includes the first and second check valves 13, 15, one of the rod-side chamber 5 and the piston-side chamber 6 that enlarges when the actuator 1 is extended or contracted by an external force can receive the supply of the liquid from the tank 7. Thus, a desired thrust force can be obtained also by cutting off the supply of the liquid from the first and second pumps 8, 9 and controlling the valve opening pressure of the first variable relief valve 12 and that of the second variable relief valve 14.

Further, since the actuator 1 includes the check valves 26, 27 provided at the intermediate positions of the supply passages 24, 25, reverse flows of the liquid from the cylinder 2 to the first and second pumps 8, 9 are prevented. Thus, even if a thrust force becomes insufficient with a torque of the motor 23 when the actuator 1 is extended or contracted by an external force, a thrust force not smaller than the thrust force caused by the torque of the motor 23 can be obtained by adjusting the valve opening pressure of the first variable relief valve 12 and that of the second variable relief valve 14 and causing the actuator 1 to function as a damper.

Next, a case where the on-off valve 28 sets the center passage 16 in a communicating state is described.

When the first and second pumps 8, 9 are driven and the piston 3 is located closer to the rod guide 18 than the through hole 2*a* communicating with the center passage 16, the pressure in the rod-side chamber 5 is adjusted to the valve opening pressure of the first variable relief valve 12 and the pressure in the piston-side chamber 6 is maintained at a tank pressure since the piston-side chamber 6 communicates with the tank 7 through the center passage 16 in addition to with the second variable relief valve 14.

In this case, the actuator 1 can exert a thrust force in a direction to push the piston 3 toward the lid 17, i.e. a thrust force in the contraction direction with the pressure in the rod-side chamber 5. However, since the pressure in the piston-side chamber 6 is the tank pressure, the piston 3 cannot be pushed toward the rod guide 18 and a thrust force in the extension direction cannot be exerted.

This state is maintained until the piston 3 faces the through hole 2*a* to close the center passage 16. Accordingly, the actuator 1 exerts no thrust force in the extension direction until stroking in a direction to compress the piston-side chamber 6 and close the center passage 16 from a state where the piston 3 is located closer to the rod guide 18 than the through hole 2*a*.

When the first and second pumps 8, 9 are driven and the piston 3 is located closer to the lid 17 than the through hole 2*a* communicating with the center passage 16, the pressure in the piston-side chamber 6 is adjusted to the valve opening pressure of the second variable relief valve 14 and the pressure in the rod-side chamber 5 is maintained at the tank pressure since the rod-side chamber 5 communicates with the tank 7 through the center passage 16 in addition to with the first variable relief valve 12.

In this case, the actuator 1 can exert a thrust force in a direction to push the piston 3 toward the rod guide 18, i.e. a thrust force in the extension direction with the pressure in the piston-side chamber 6. However, since the pressure in the rod-side chamber 5 is the tank pressure, the piston 3 cannot be pushed toward the lid 17 and a thrust force in the contraction direction cannot be exerted.

This state is maintained until the piston 3 faces the through hole 2*a* to close the center passage 16. Accordingly, the actuator 1 exerts no thrust force in the contraction direction until stroking in a direction to compress the rod-side chamber 5 and close the center passage 16 from a state where the piston 3 is located closer to the lid 17 than the through hole 2*a*.

It should be noted that if the piston 3 is located closer to the rod guide 18 than the through hole 2*a* communicating with the center passage 16 in a state where the on-off valve 28 sets the center passage 16 in the communicating state, the first and second pumps 8, 9 are not driven and the actuator 1 is caused to function as a damper, the pressure in the rod-side chamber 5 can be adjusted to the valve opening pressure of the first variable relief valve 12 when the actuator 1 extends. At this time, since the piston-side chamber 6 is maintained at the tank pressure through the center passage 16, the actuator 1 can exert a thrust force in the contraction direction to resist the extension of the actuator 1. On the contrary, when the actuator 1 contacts, the first check valve 13 is opened and the pressure in the rod-side chamber 5 is also set at the tank pressure, therefore the actuator 1 cannot exert a thrust force in the extension direction.

This state is maintained until the piston 3 faces the through hole 2*a* to close the center passage 16. Accordingly, the actuator 1 exerts no thrust force in the extension direction until stroking in the direction to compress the piston-side chamber 6 and close the center passage 16 from the state where the piston 3 is located closer to the rod guide 18 than the through hole 2*a*.

Further, when the piston 3 is located closer to the lid 17 than the through hole 2*a* communicating with the center passage 16, the pressure in the piston-side chamber 6 can be adjusted to the valve opening pressure of the second variable relief valve 14 when the actuator 1 contracts. At this time, since the rod-side chamber 5 is maintained at the tank pressure through the center passage 16, the actuator 1 can exert a thrust force in the extension direction to resist the contraction of the actuator 1. On the contrary, when the actuator 1 extends, the second check valve 15 is opened and the pressure in the piston-side chamber 6 is also set at the tank pressure, therefore the actuator 1 cannot exert a thrust force in the contraction direction.

This state is maintained until the piston 3 faces the through hole 2*a* to close the center passage 16. Accordingly, the actuator 1 exerts no thrust force in the contraction direction until stroking in the direction to compress the rod-side chamber 5 and close the center passage 16 from the state where the piston 3 is located closer to the lid 17 than the through hole 2*a*.

That is, when the on-off valve 28 sets the center passage 16 in the communicating state and the actuator 1 functions as an actuator, a thrust force can be exerted only in a direction to return the piston 3 to the center of the cylinder 2. When the actuator 1 functions as a damper, a counteracting thrust force is exerted only when the piston 3 strokes in a direction away from the center of the cylinder 2. That is, the actuator 1 exerts a thrust force only in the direction to return the piston 3 to the neutral position regardless of whether the actuator 1 functions as an actuator or as a damper and regardless of whether the piston 3 is at a side closer to the rod guide 18 or at a side closer to the lid 17 than the neutral position.

Figure 2:
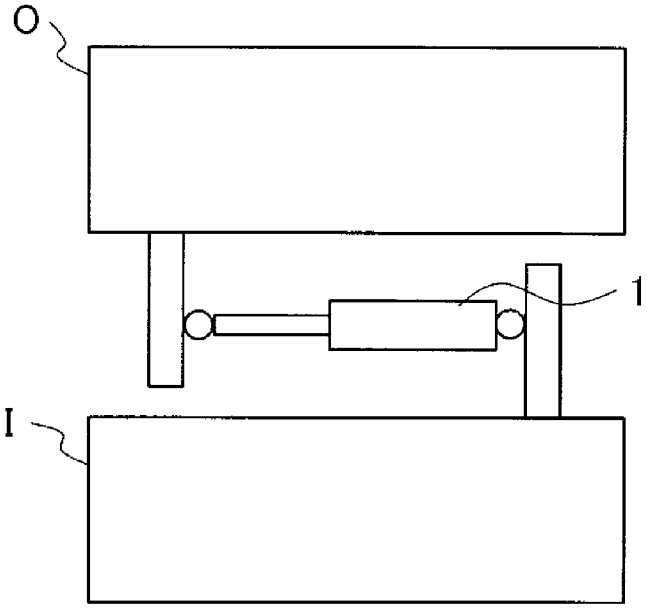
FIG. 2 is a diagram showing a state where the actuator according to the embodiment of the present invention is interposed between a vibration control object and a vibration input unit.
Figure 3:
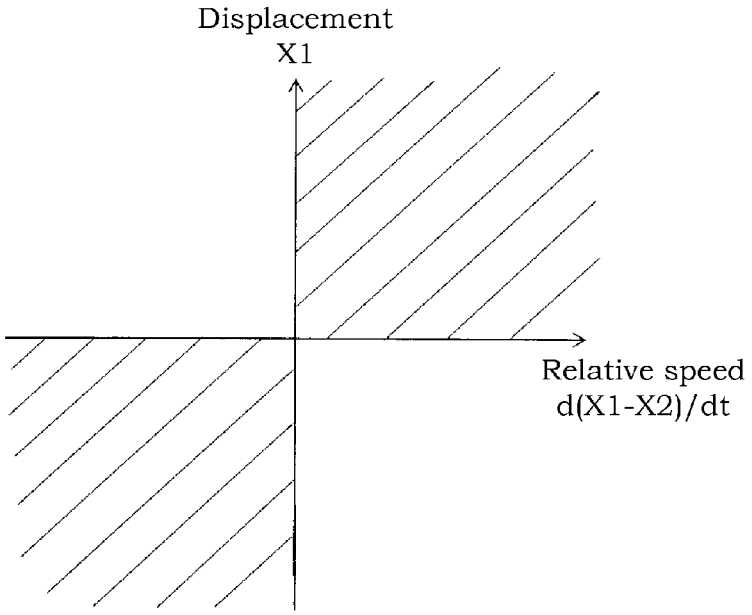
FIG. 3 is a graph showing a state where the actuator according to the embodiment of the present invention exerts a thrust force and a state where it exerts no thrust force.

Here, a model is considered in which the actuator 1 is interposed between a vibration control object O and a vibration input unit I as shown in FIG. 2. If X1 denotes a lateral displacement of the vibration control object O, X2 denotes a lateral displacement of the vibration input unit I and d(X1−X2)/dt denotes a relative speed of the vibration control object O and the vibration input unit I in FIG. 2, a rightward displacement in FIG. 2 is positive, a vertical axis represents the displacement X1 and a horizontal axis represents the relative speed d(X1−X2)/dt, the actuator 1 exerts a damping force in states in first and third quadrants shown by oblique lines in FIG. 3.

Figure 4:
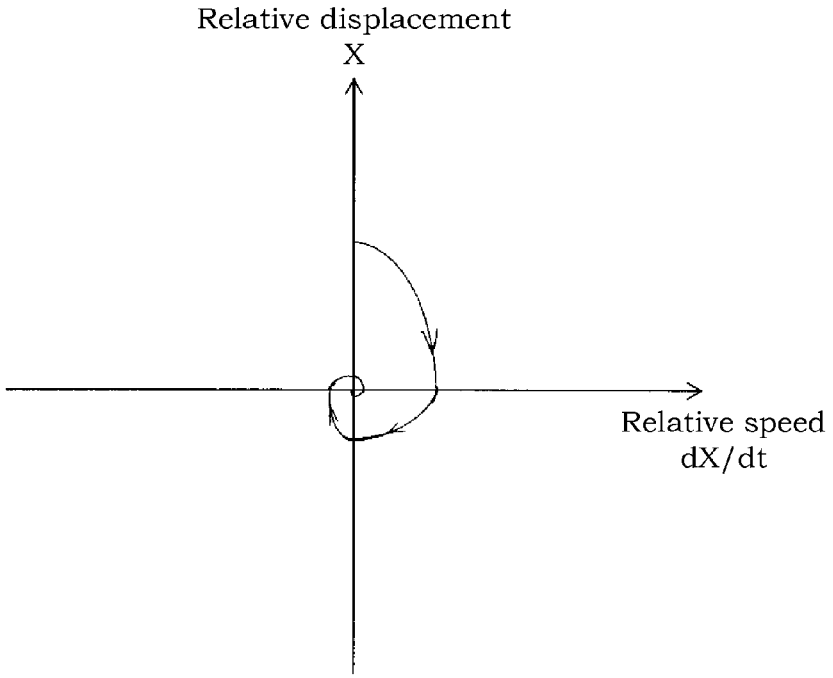
FIG. 4 is a graph showing a locus of a relative displacement and a relative speed of the vibration control object and the vibration input unit, to which the actuator according to the embodiment of the present invention is applied.

A case where the actuator 1 exerts a thrust force is equivalent to an increase in the apparent stiffness of the actuator 1 and a case where the actuator 1 exerts no thrust force is equivalent to a reduction in the apparent stiffness. Accordingly, if the vibration control object O is displaced relative to the vibration input unit I with a relative displacement of the vibration input unit I and the vibration control object O set at X and a relative speed set at dX/dt, a locus converges to an origin on a phase plane of the relative displacement X and the relative speed dX/dt as shown in FIG. 4. Specifically, asymptotic stability is achieved and no divergence is seen.

As described above, since the actuator 1 is provided with the center passage 16 in the present embodiment, the actuator 1 does not exert such a thrust force as to assist the separation of the piston 3 from the neutral position and vibration more easily converges. Accordingly, the vibration of the vibration control object O can be stably suppressed. For example, if the actuator 1 is used between a vehicle body and a truck of a railway vehicle, such a thrust force as to assist the separation of the piston 3 from the neutral position is not exerted after the piston 3 passes through the neutral position even if steady acceleration acts on the vehicle body and a thrust force output by the actuator becomes extremely large due to noise and drift input to an acceleration sensor when the railway vehicle is traveling in a curved section. That is, since the vehicle body is not vibrated after the passage through the neutral position, vibration more easily converges and ride comfort of the railway vehicle is improved.

In the present embodiment, it is not necessary to control the first and second variable relief valves 12, 14 in conjunction with the stroke of the actuator 1 in realizing the above movement. Accordingly, a stroke sensor is not necessary and vibration can be suppressed without depending on a sensor output including an error. Thus, vibration suppression with high robustness can be performed.

Further, since the on-off valve 28 is provided in the center passage 16 of the actuator 1 in the present embodiment, a state where the center passage 16 is opened and a state where it is blocked can be switched. Accordingly, if the center passage 16 is blocked, the actuator 1 can function as a general actuator which exerts a thrust force in both directions during the entire stroke and versatility is improved. Further, by opening the center passage 16 when necessary, stable vibration suppression can be realized. For example, in the case of low-frequency vibration such as when vibration with a low frequency and a high wave height is input, vibration may be suppressed by opening the center passage 16. A control mode for suppressing vibration needs not be switched as the center passage 16 is opened and closed. That is, it is not necessary to change a control mode as the center passage 16 is opened and closed while the vibration of the vibration control object O is suppressed in a certain control mode such as a skyhook control or an H-infinity control, therefore it is also not necessary to execute a cumbersome control.

Further, since the on-off valve 28 is set at the communication position 29*a* at the time of non-energization, stable vibration suppression can be performed by opening the center passage 16 in the event of a failure. It should be noted that the on-off valve 28 can be set at the blocking position 29*b* when power supply is disabled. Further, it is also possible to give resistance to the flow of the passing liquid when the on-off valve 28 is set at the communication position 29*a*.

Further, since an opening of the center passage 16 is at a position located in the center of the cylinder 2 and facing the stroke center of the piston 3 in the actuator 1, there is no unevenness in both directions in stroke ranges where no damping force is exerted when the piston 3 returns to the stroke center and the entire stroke length of the actuator 1 can be effectively utilized.

Embodiments of this invention were described above, but the above embodiments are merely examples of applications of this invention, and the technical scope of this invention is not limited to the specific constitutions of the above embodiments.

Although the vibration control object O and the vibration input unit I have been described to be the vehicle body and the truck of the railway vehicle in the above embodiment, the actuator 1 can be used in applications for approximately suppressing vibration such as between a building and a ground without being limited to the use in railway vehicles.

With respect to the above description, the contents of application No. 2012-192754, with a filing date of Sep. 3, 2012 in Japan, are incorporated herein by reference.

The invention claimed is:

1. An actuator, comprising:

a cylinder;

a piston slidably inserted into the cylinder;

a rod inserted into the cylinder and coupled to the piston;

a rod-side chamber and a piston-side chamber partitioned by the piston in the cylinder;

a tank;

a first pump capable of supplying liquid to the rod-side chamber;

a second pump capable of supplying the liquid to the piston-side chamber;

a first control passage allowing communication between the rod-side chamber and the tank;

a second control passage allowing communication between the piston-side chamber and the tank;

a first variable relief valve provided at an intermediate position of the first control passage and capable of changing a valve opening pressure for permitting a flow of the liquid from the rod-side chamber toward the tank by being opened when a pressure in the rod-side chamber reaches the valve opening pressure;

a second variable relief valve provided at an intermediate position of the second control passage and capable of changing a valve opening pressure for permitting a flow of the liquid from the piston-side chamber to the tank by being opened when a pressure in the piston-side chamber reaches the valve opening pressure; and a center passage allowing communication between the tank and the interior of the cylinder.

2. The actuator according to claim 1, further comprising:

a first check valve provided at an intermediate position of the first control passage in parallel with the first variable relief valve and configured to permit only the passage of the liquid flowing from the tank to the rod-side chamber; and a second check valve provided at an intermediate position of the second control passage in parallel with the second variable relief valve and configured to permit only the passage of the liquid flowing from the tank to the piston-side chamber.

3. The actuator according to claim 1, wherein:

the center passage is open at a position located in the center of the cylinder and facing a stroke center of the piston.

4. The actuator according to claim 1, wherein:

an on-off valve for opening and closing the center passage is provided at an intermediate position of the center passage.

5. The actuator according to claim 1, wherein:

the first and second pumps are tandem pumps which are both driven by a single motor.

* * * * *